US007802314B2

(12) United States Patent
Cohen

(10) Patent No.: US 7,802,314 B2
(45) Date of Patent: Sep. 28, 2010

(54) HAND-WEAR ARTICLE WITH CUTANEOUS SENSORY ELEMENTS

(75) Inventor: Jason C. Cohen, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 283 days.

(21) Appl. No.: 11/931,513

(22) Filed: Oct. 31, 2007

(65) Prior Publication Data

US 2009/0113600 A1 May 7, 2009

(51) Int. Cl.
*A41D 19/00* (2006.01)

(52) U.S. Cl. ..... 2/161.1

(58) Field of Classification Search ..... 2/161.1, 2/161.6

See application file for complete search history.

(56) References Cited

U.S. PATENT DOCUMENTS

| | | | | |
|---|---|---|---|---|
| 3,072,914 | A | 1/1963 | Velonis et al. | |
| 3,148,235 | A | 9/1964 | Velonis et al. | |
| 3,748,792 | A * | 7/1973 | Lamb | 451/523 |
| 3,761,965 | A | 10/1973 | Barasch | |
| 4,084,265 | A | 4/1978 | Anfelt | |
| 4,745,635 | A | 5/1988 | Kinnear | |
| 5,448,777 | A | 9/1995 | Lew | |
| 5,467,481 | A * | 11/1995 | Srivastava | 2/161.7 |
| 5,794,266 | A | 8/1998 | Han | |
| 5,958,976 | A | 9/1999 | Muizzuddin et al. | |
| 5,983,395 | A | 11/1999 | Lei | |
| 6,455,592 | B1 | 9/2002 | Laugier et al. | |
| 6,562,794 | B1 | 5/2003 | Lanzendorfer et al. | |
| 6,858,000 | B1 | 2/2005 | Schukin et al. | |
| 6,879,848 | B2 | 4/2005 | Lygas | |
| 6,912,731 | B2 * | 7/2005 | Cass | 2/161.1 |
| 2005/0059664 | A1 | 3/2005 | Gil et al. | |
| 2005/0288647 | A1 | 12/2005 | Ellingson et al. | |
| 2006/0218697 | A1 | 10/2006 | Modha et al. | |
| 2007/0136926 | A1 | 6/2007 | Johnson et al. | |

FOREIGN PATENT DOCUMENTS

| | | | |
|---|---|---|---|
| WO | 0220056 | A2 | 3/2002 |
| WO | 03091281 | A1 | 11/2003 |
| WO | 03093479 | A1 | 11/2003 |

OTHER PUBLICATIONS

Gescheider, G. A., et al, The Effects of Aging on Information-Processing Channels in the Sense of Touch: I. Absolute Sensitivity, Somatosensory and Motor Research, Oct. 18, 1994, pp. 345-357, vol. 11, No. 4.

(Continued)

*Primary Examiner*—Katherine Moran
(74) *Attorney, Agent, or Firm*—Armstrong Teasdale, LLP

(57) ABSTRACT

A hand-wear article heightens the neurosensory response of the skin of the wearer. The article includes a substrate having a skin-facing surface and a plurality of cutaneous sensory elements located on the substrate. The sensory elements are configured to have a sharpness frequency in the range of about 100 Hz to about 1,000 Hz and a height in the range of about 0.1 microns to about 1000 microns.

22 Claims, 5 Drawing Sheets

OTHER PUBLICATIONS

Johnson, Kenneth, O., et al, Neural Mechanisms of Spatial Tactile Discrimination: Neural Patterns Evoked by Braille-Like Dot Patterns in the Monkey, Journal of Physiology, 1981, pp. 117-144, The Physiological Society.

Bolanowski, Jr., et al., Four Channels Mediate the Mechanical Aspects of Touch, Journal of Acoustical Society of America, Nov. 1988, pp. 1680-1694, Issue 84 (5), Acoustical Society of America, USA.

Militky, Jiri, et al., Surface Roughness and Fractal Dimension, Date Unknown, 23 pages.

Watanabe, T., et al., A Method for Controlling Tactile Sensation of Surface Roughness Using Ultrasonic Vibration, IEEE International Conference on Robotics and Automation, pp. 1134-1139, vol. 1 of 3, 1995, Japan.

Murray, Anne, M., et al., Psychophysical Characterization and Testbed Validation of a Wearable Vibrotactile Glove for Telemanipulation, Presence: Teleoperators & Virtual Environments, Apr. 2003, vol. 12, No. 2, pp. 156-182.

Caldwell, Darwin, G., et al., Multi-Modal Cutaneous Tactile Feedback, Proceedings of the 1996 IEEE/RSJ International Conference on Intelligent Robots and Systems, vol. 2, pp. 465-472, Nov. 4, 1996-Nov. 8, 1996.

Caldwell, Darwin, G., et al., Tactile Perception and its Application to the design of Multi-modal Cutaneous Feedback Systems, Proceedings of the 1996 IEEE, International Conference on Intelligent Robotics and Automations, pp. 3215-3221, Apr. 1996.

International Search Report for PCT/IB2008/053938, dated Feb. 24, 2009, 2 pages.

* cited by examiner

HAND-WEAR ARTICLE WITH CUTANEOUS SENSORY ELEMENTS

BACKGROUND

This invention relates generally to articles that are worn on a person's hand, and more particularly to such articles having cutaneous sensory elements for heightening the tactile sensitivity of the wearer.

In one known model of mechanoreception (in which skin is stimulated due to tactile receptors that respond to mechanical stimuli, e.g., a change in pressure), referred to as a four-channel model, four information-processing channels exist for the human skin (e.g., including on one's hand), with each channel being mediated by a morphologically distinct receptor type innervated by a specific nerve fiber type and tuned to a different range of frequencies. In general, the four psychophysical channels at their absolute thresholds have overlapping frequency characteristics for detection of sinusoidal vibration, with each channel optimally tuned to a specific region of the spectrum. As individuals age, their tactile acuity decreases making it more difficult from them to feel objects, especially objects with smooth surfaces. For example, in one known study a 20 decibel (dB) or ten fold reduction in tactile sensitivity between 20 year old subjects and 80 year old subjects was identified. See Gescheider et al., *The Effects of Aging on Information-Processing Channels in the Sense of Touch: I. Absolute Sensitivity*, Somatosensory and Motor Research, Vol. 11, No. 4, 1994, pp. 345-357. In addition, the Gescheider et al. study showed that the decrease in tactile sensitivity occurred at a younger age in male subjects as compared to female subjects. In other words, the male subjects exhibited a greater decrease in tactile sensitivity compared to the female subjects of the same age.

There is a need, therefore, to provide a person with an increased mechanoreceptor response when grasping objects, and in particular relatively smooth surface objects.

SUMMARY OF THE DISCLOSURE

In one aspect, a hand-wear article for heightening the neurosensory response of the skin of the wearer generally comprises a substrate having a skin-facing surface and a plurality of cutaneous sensory elements located on the substrate. The sensory elements are configured to define a surface roughness having a sharpness frequency in the range of about 100 Hz to about 1,000 Hz and a height in the range of about 0.1 microns to about 1000 microns.

In another aspect, a hand-wear article for heightening the neurosensory response of a wearer's skin has a skin-facing surface and generally comprises a compressible member and a plurality of cutaneous sensory elements. The compressible member is compressible from an uncompressed condition to a compressed condition thereof. The compressible member and the sensory elements are arranged relative to each other and to the skin-facing surface of the article such that in the uncompressed condition the compressible member generally hides the plurality of cutaneous sensory elements to inhibit contact of the sensory elements with the skin. The sensory elements are exposed in the compressed condition of the compressible member for contact of the sensory elements with the wearer's skin.

In still another aspect, a hand-wear article for heightening the neurosensory response of a wearer's skin has a skin-facing surface and generally comprises a strip including a substrate. Adhesive on the substrate is for adhering the substrate to the wearer's skin. A plurality of cutaneous sensory elements are located at least one of on the skin-facing surface of the article, within the substrate and within the adhesive.

DETAILED DESCRIPTION

Figure 1:
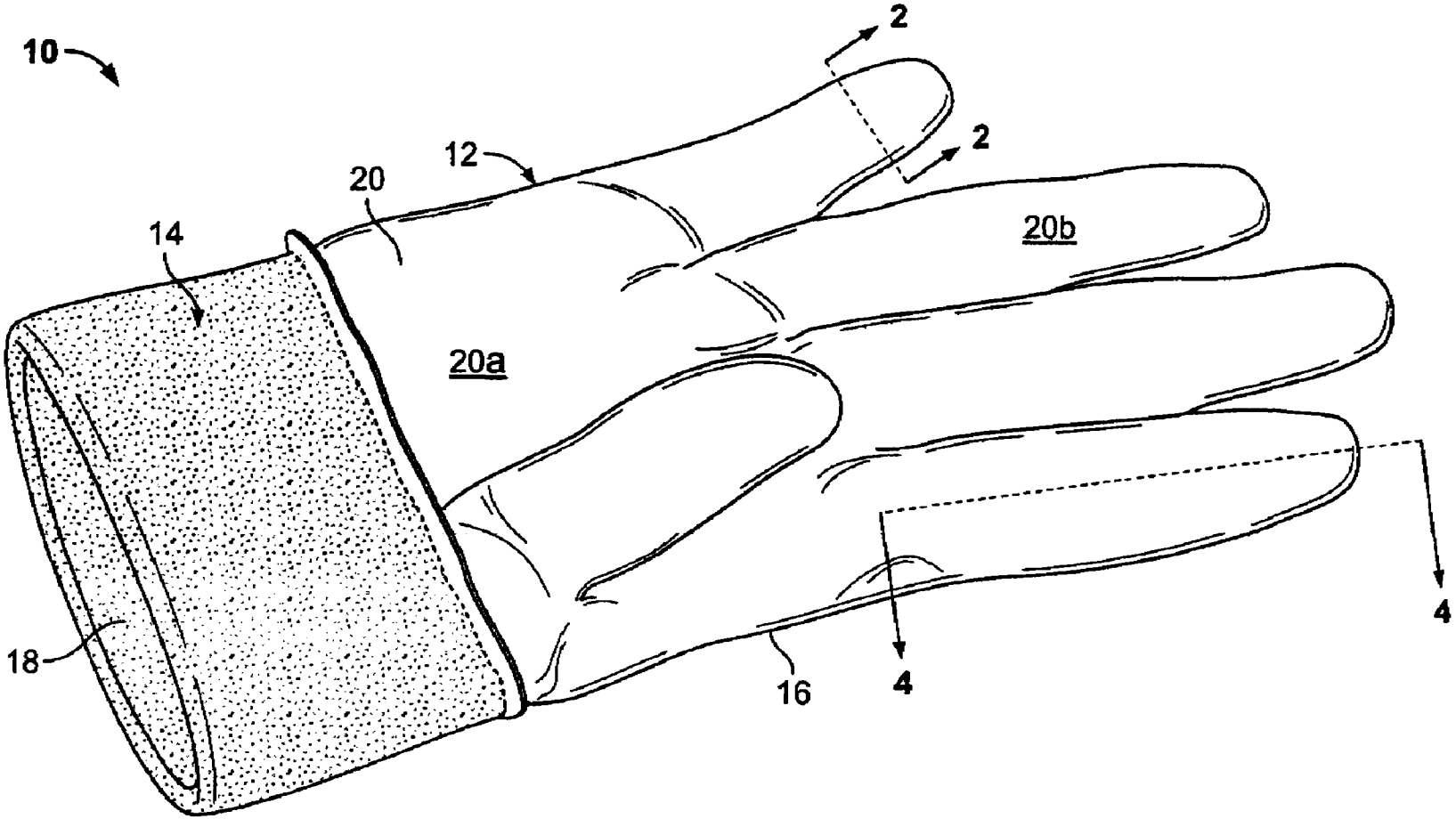
FIG. 1 is a perspective view of a first embodiment of a hand-wear article in the form of a glove with a portion of the glove being turned inside out to reveal cutaneous sensory elements located on an inner surface of the glove.
Figure 2:
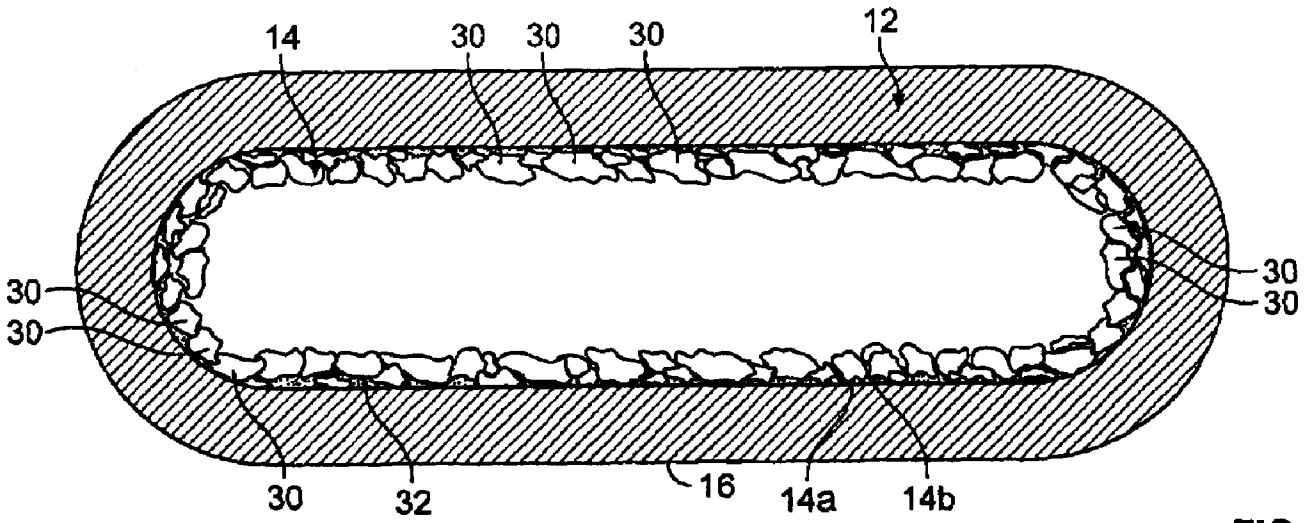
FIG. 2 is an enlarged cross-section of the glove taken along line 2-2 of FIG. 1.

With reference now to the drawings and in particular to FIGS. 1 and 2, one embodiment of a hand-wear article is illustrated and further described herein in connection with the article being in the form of a glove, indicated generally at 10. It is understood, however, that the hand-wear article may be other than a glove, such as, an adhesive strip. As illustrated in FIGS. 1 and 2, the glove 10 comprises a substrate 12 having an outer surface 16, an inner surface 18 (broadly, a skin-facing surface), and a plurality of cutaneous sensory elements, indicated generally at 14, located on the inner surface for heightening the tactile sensitivity of a user. In the illustrated embodiment, the cutaneous sensory elements 14 extend inward from the substrate 12 (although in the illustrated embodiment of FIG. 1 they extend outward because the glove 10 is inside-out) so that the cutaneous sensory elements contact the glove wearer's skin.

The glove 10 further comprises a front 20 having a front palm region 20*a* and a front finger region 20*b*, and a back (not shown) having a back palm region and a back finger region. In one suitable configuration, the cutaneous sensory elements 14 are located throughout substantially the entire inner surface 18 of the glove 10. In another suitable configuration, the cutaneous sensory elements 14 are located on the inner surface 18 of the glove 10 only within the front palm region 20*a* and/or the front finger region 20*b*. In other suitable embodiments, the cutaneous sensory elements 14 can be disposed on the outer surface 16 of the substrate 12 or embedded in the substrate. The outer surface 16 of the illustrated substrate 12 is generally smooth but it is understood that the outer surface may be textured or otherwise altered to increase the gripping capability of the outer surface of the glove 10 as is known in the art.

In a particularly suitable embodiment, the cutaneous sensory elements 14 are sized and located on the glove 10, and more particularly on the substrate 12, to define a surface roughness having a desired sharpness frequency to increase the tactical response of the wearer. As used herein, such a tactical response is described in terms of one known model of mechanoreception referred to as a four-channel model and described particularly by Gescheider et al. in *The Effects of Aging on Information-Processing Channels in the Sense of Touch: I. Absolute Sensitivity*, Sensory and Motor Research, Vol. 11, No. 4, 1994, pp. 345-347; and by Bolanowski et al. in *Four Channels Mediate the Mechanical Aspects of Touch*, The Journal of the Acoustical Society of America, Vol. 84(5), 1988, pp. 1680-1694. In this model, four information-processing channels exist for the human skin, with each channel being mediated by a morphologically distinct receptor type innervated by a specific nerve fiber type and tuned to a different range of frequencies. In general, the four psychophysical channels at their absolute thresholds have overlapping frequency characteristics, with each channel optimally tuned to a specific region of the spectrum.

Figure 9:
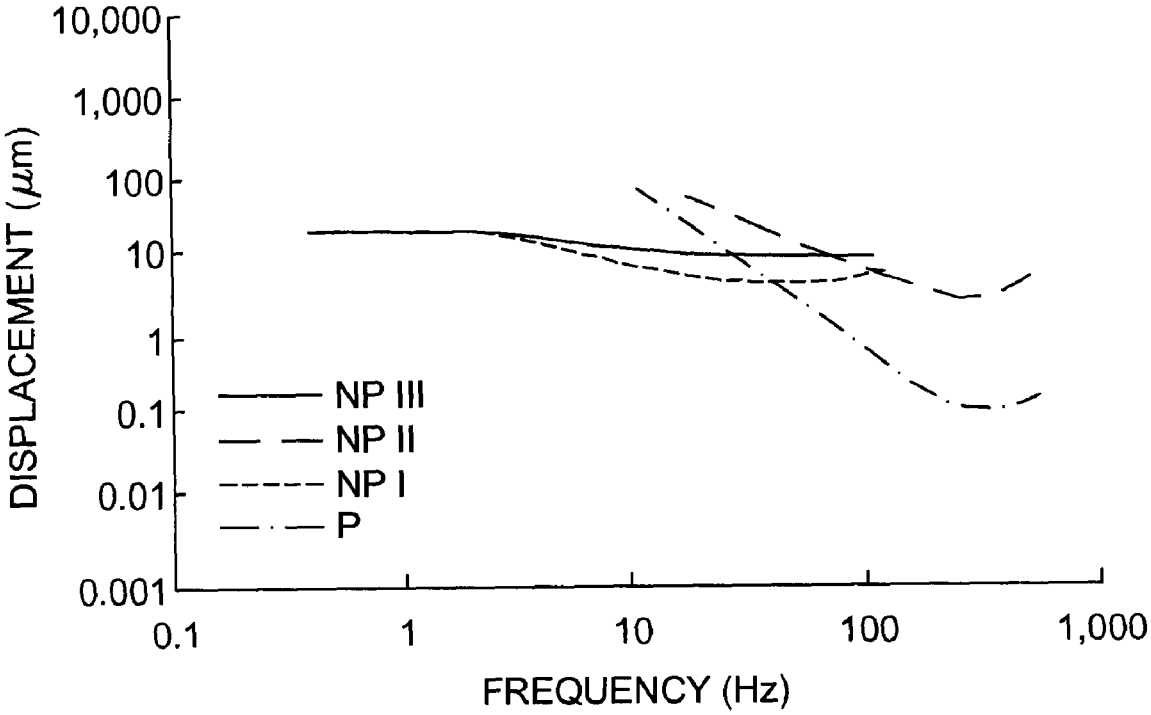
FIG. 9 is a graph of the relationship between sharpness frequency and displacement for multiple sensory channels.

Specifically, with reference to the data of FIG. 9, a P channel, mediated by Pacinean corpuscles (PC) and PC fibers, has a highly tuned U-shaped frequency characteristic with optimal sensitivity between 200-300 Hz and produces a sensation of vibration. A NP I channel, mediated by Meissner corpuscles and readily adapting (RA) fibers, is broadly tuned and produces sensations of flutter in the frequency range of 2-40 Hz. A NP II channel, mediated by Ruffini end organs and slowly adapting type II (SA II) fibers, is tuned at 200-400 Hz and responds over a wide range of frequencies. And a NP III channel, mediated by Merkel cell-neurite complexes and slowly adapting type I (SA I) fibers, produces a sensation of pressure in the frequency range of 0.4-2 Hz.

For a wearer to experience a tactile sensation, a particular area or region of the skin must experience a combination of depth compression (e.g., from the cutaneous sensory element 14 pushing in against the skin to a certain depth) and sharpness frequency, such that the response thereto falls on or above one of the threshold lines for at least one of the channels in the above data plot. Consequently, when a response falls below all of the threshold lines, a tactile sensation is unlikely to be felt when wearing the glove 10.

The term "sharpness frequency" as used herein refers generally to the higher frequency component of the surface roughness defined by the cutaneous sensory elements 14 (or by a single cutaneous sensory element where only one element is present) on the glove (broadly the hand-wear article) substrate 12. The sharpness frequency is particularly defined by the sharpness of the peaks, outward facing edges or other relatively sharp surfaces of the sensory elements 14 that are contacted by (and depressed into) the wearer's skin upon compression of the wearer's skin against the sensory elements.

In one particularly suitable embodiment, the sharpness frequency and the height of the cutaneous sensory elements 14 may be suitably determined via optics, profilometry, or other imaging techniques. One particularly suitable embodiment utilizes non-contact laser profilometry in which the surface (e.g., the surface defined by the cutaneous sensory elements 14) is scanned in the X-Y-Z directions at various resolutions/spacing. The scanning should be such that a sufficient number of amplitude/wavelength ranges are scanned for measurements. The scanned data may be represented as point-cloud ASCII format or any other suitable format. Additionally, the data can be transformed as necessary from the range of point-cloud raw data to completed surface data that can be exported to a CAD system or any other suitable high-end surface format.

The amplitude (e.g., height) and sharpness frequency (e.g., wavelength) determinations may be performed via various suitable analysis techniques and/or programs. For example, one such analysis is a spectral analysis, or Fourier analysis, which is known to those skilled in the art, to determine the frequencies, and in particular relatively high frequencies, defined by the surface roughness. For example, one suitable such analysis is described in Militky et al., *Surface Roughness and Fractal Dimension*, Journal of the Textile Institute, 2001, Vol. 92 Issue 3, p 101-123. It is understood, however, that the height and/or wavelength (e.g., sharpness frequency) defined by the cutaneous sensory elements 14 may be determined by other suitable techniques without departing from the scope of this invention.

As mentioned above, an individual's ability to feel objects when grasping or touching such objects (i.e., tactile sensitivity) decreases with age. That is, the individual's mechanoreceptors are less responsive than they were when the individual was younger. It is also understood that some individuals have reduced tactile sensitivity for reasons other than aging (e.g., nerve damage) and the hand-wear article disclosed herein may be used to increase their tactile sensitivity as well. In particular, providing the internal cutaneous sensory elements 14 on the skin-facing surface of the substrate 12 translates low frequency surfaces of objects (e.g., smooth or substantially smooth objects) to higher frequency compression against the wearer's skin (e.g., against the fingers and/or palm) upon grasping or touching the objects while wearing the glove 10.

The substrate 12 of the glove 10 can comprise any suitable material such as, without limitation, a non-woven material, a woven material or fabric, a film, or a laminate or other combination of these materials. For example, the substrate 12 in one embodiment may be formed of natural latex, synthetic latex, or a dissolved elastomeric polymer such as a natural rubber, a nitrile rubber, a polyurethane, a homopolymer of a conjugated diene, a copolymer of a least two conjugated dienes, a copolymer of at least one conjugated diene and at least one vinyl monomer, or any other suitable combinations thereof. If the substrate 12 is a non-woven material, the non-woven material may suitably comprise a fibrous non-woven web which as used herein refers to a structure of individual fibers or filaments randomly arranged in a mat-like fashion that may but need not necessarily include a binder material to facilitate binding together of the fibers. Suitable non-woven webs may be made from a variety of known processes including, but not limited to, airlaid processes, wet-laid processes such as with cellulosic-based tissues or towels, coforming processes, hydroentangling processes, staple fiber carding and bonding, and solution spinning. The fibrous non-woven substrate may be formed from a single web layer or multiple web layers.

Where the substrate 12 comprises multiple layers, the layers are generally positioned in a juxtaposed or surface-to-surface relationship and all or a portion of the layers may be bound to adjacent layers. The multi-layers may be of the same material or different material. For example, the substrate 12 of the glove may comprise a non-woven web that is laminated or otherwise secured to a film, a woven material or a different non-woven web without departing from the scope of this invention.

In the illustrated embodiment, the cutaneous sensory elements 14 are suitably configured to generally have a base **14*a*** secured to the substrate 12 and a free, or skin-contact end 14*b* (i.e., peak) intended for contact with the wearer's skin to evoke a sensory event. The skin-contact ends 14*b* of the cutaneous sensory elements 14 suitably have one or more relatively sharp edges, points or corners to facilitate a sensory response upon compression of the glove 10 as a result of the wearer grasping or touching an object.

Suitably, the cutaneous sensory elements 14 are formed separate from the substrate 12 and secured thereto, such as by adhesive, thermal or pressure bonding, or other suitable securement technique. For example, in one particularly suitable embodiment the sensory elements 14 comprise a plurality of discrete particles 30 having irregular surfaces that define relatively sharp edges, points and/or corners at the free ends 14*b* of the particles. In a more particular example, the cutaneous sensory elements 14 comprise a plurality of rough sand particles. In another suitable embodiment, the sensory elements 14 may comprise a plurality of rough polymer particles. It is understood, however, that other suitable materials besides sand and polymer particles may be used as the cutaneous sensory elements 14 without departing from the scope of this invention.

It is also contemplated that the cutaneous sensory elements 14 may be added during the formation of the glove 10. For example, the cutaneous sensory elements 14 can be mixed into a liquid dip before the gloves are dipped therein, e.g., if the gloves are formed using a dipping process. Alternatively, the sensory elements 14 may be sprayed, coated or printed on, or otherwise applied to the skin-facing surface of the substrate 12 either with adhesive or after adhesive has already been applied to the skin-facing surface 18. In still other embodiments, the cutaneous sensory elements 14 may be formed integrally with the substrate 12 without departing from the scope of this invention.

It is further contemplated that the cutaneous sensory elements 14 may instead be disposed on the outer surface 16 of the substrate 12, between layers of a multi-layer substrate, or otherwise embedded within the substrate. In these embodiments, the particles 30 are sufficiently shaped that the selected receptor channel of the wearer is triggered upon the application of sufficient pressure (e.g., grasping a glass to pick up). That is, the wearer can feel the cutaneous sensory elements 14 through the substrate 12 or layers of the substrate. The substrate 12 in such an embodiment is thus suitably compressible and/or thin to permit the sensory elements 14 to be compressed into the wearer's skin upon grasping or touching objects while wearing the article. In another configuration, the cutaneous sensory elements 14 and the substrate 12 are configured so that the sensory elements rupture the substrate or layers of the substrate upon compression thereby bringing the cutaneous sensory elements into direct contact with the wearer's skin. The cutaneous sensory elements 14 can be randomly distributed throughout the glove 10, as illustrated in FIG. 1, or can be disposed in a pattern or otherwise non-randomly arranged on the substrate 12.

In one suitable embodiment, the cutaneous sensory elements 14 define a surface roughness having a sharpness frequency at least in the range of about 100 Hz to about 1,000 Hz, more suitably about 100 Hz to about 500 Hz, even more suitably about 200 Hz to about 400 Hz, and still more suitably about 200 Hz to about 300 Hz. Even more suitably the sharpness frequency is about 250 Hz which as seen in the above data plot is a frequency at which the skin (and in particular the P-channel receptor) is the most sensitive. At 250 hertz, for example, a typical individual can feel compression depths (which as used herein is roughly the same as the sensory element 14 heights above, or outward of, the skin-facing surface 18 of the substrate 12 or other surface that otherwise defines a relative base of the sensory element, i.e., prevents further penetration of the sensory element into the skin) as small as 0.1 microns. Thus, in one suitable embodiment where the sharpness frequency is in the range of about 100 Hz to about 1000 Hz, the height of the sensory elements 14 is suitably sufficient such that the response thereto lies on or above the threshold response level at that frequency (e.g., as determined by reference to the above data plot). More suitably, the height of the sensory elements 14 is suitably in the range of about 0.1 microns to about 1000 microns, more suitably about 0.1 microns to about 500 microns, still more suitably about 0.1 microns to about 100 microns, still more suitably about 0.1 microns to about 10 microns, still more suitably about 0.1 microns to about 5 microns, still more suitably about 0.1 microns to about 1 micron, and still more suitably about 0.1 microns to about 0.5 microns.

As a contrast, the typical individual cannot feel displacement below 30 microns at relatively low frequencies, e.g., 5 hertz, which corresponds to the NP-III channel. The difference in sensitivity between the high frequency receptors and the lower frequency receptors is approximately 50 dB (or 30 fold). As a result, the cutaneous sensory elements 14 are configured for triggering the highly sensitivity P channel or NP-II channel receptors.

The glove 10 may also be provided with one or more additives or coatings that provide a benefit to the skin of a wearer. For instance, the additive or coating may comprise an anti-microbial agent, a bacteriostatic agent, a liquid absorption agent, a medicament, a therapeutic agent, mixtures thereof and the like. Examples of other therapeutic agents include various cosmetic agents, bath oils, hand lotions, aloe vera, and the like. Still other therapeutic agents include emollients such as beeswax, butyl stearate, ceramides, cetyl palmitate, oleyl alcohol, petroleum jelly, glycerol stearate, lanolin, cetearyl alcohol, stearyl alcohol, and derivatives thereof. Other additives include antioxidants such as Vitamin C, Vitamin E and the like, chelating agents such as EDTA and various other skin conditioners such as amino acids, alpha-hydroxy acids, shea butter, and the like.

In use, the glove 10 (broadly, the hand-wear article) having the internal cutaneous sensory elements 14 is configured to heighten an individual's tactile sensitivity, such as by locating the sensory elements on the substrate 12 to define a surface roughness having a sharpness frequency in the range of about 100 Hz to about 1,000 Hz. When an individual wearing the glove 10 picks up or otherwise touches an object, the cutaneous sensory elements 14 are pressed into the wearer's skin. With the sensory element height being in the range of about 0.1 microns to about 1000 microns, the wearer's high frequency receptors (i.e., the P channel receptors) are stimulated at or above the threshold response level to thereby evoke a neurosensory response that provides the wearer with increased sensitivity, e.g., feel, of the pressure needed to pick up or manipulate an object.

Figure 3:
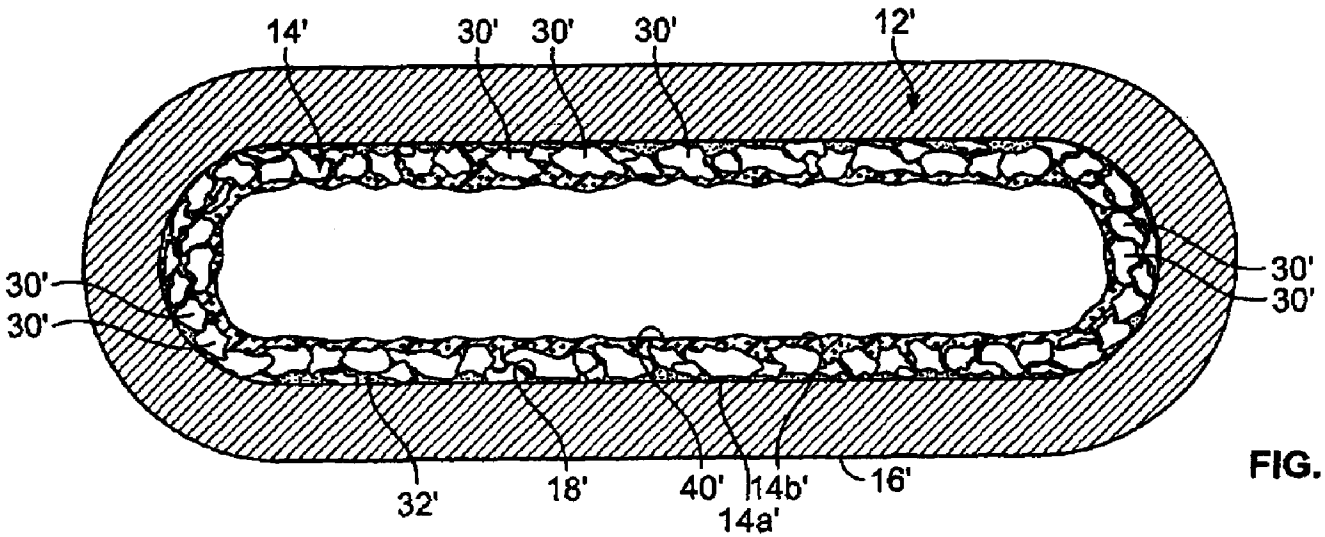
FIG. 3 is an enlarged cross-section similar to FIG. 2 but showing another configuration of the glove wherein a compressible member on the innser surface of the glove generally hides the cutaneous sensory elements in an uncompressed condition of the compressible member.
Figure 4:
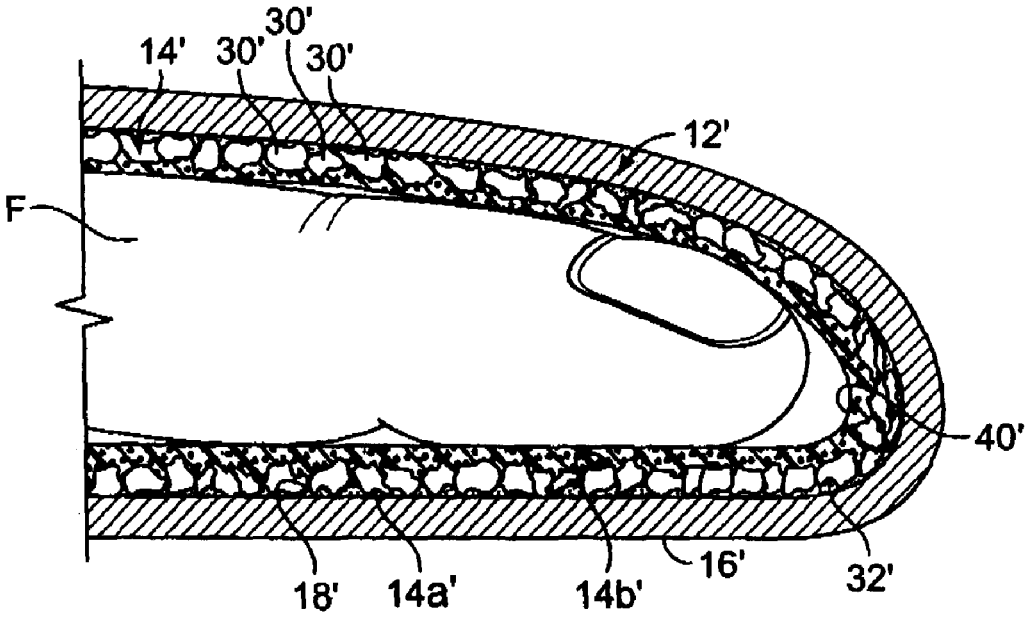
FIG. 4 is an enlarged cross-section of the glove of FIG. 3 but taken along a plane similar to that taken along line 4-4 of FIG. 1 with a wearer's finger in the glove and the compressible member in its uncompressed condition.
Figure 5:
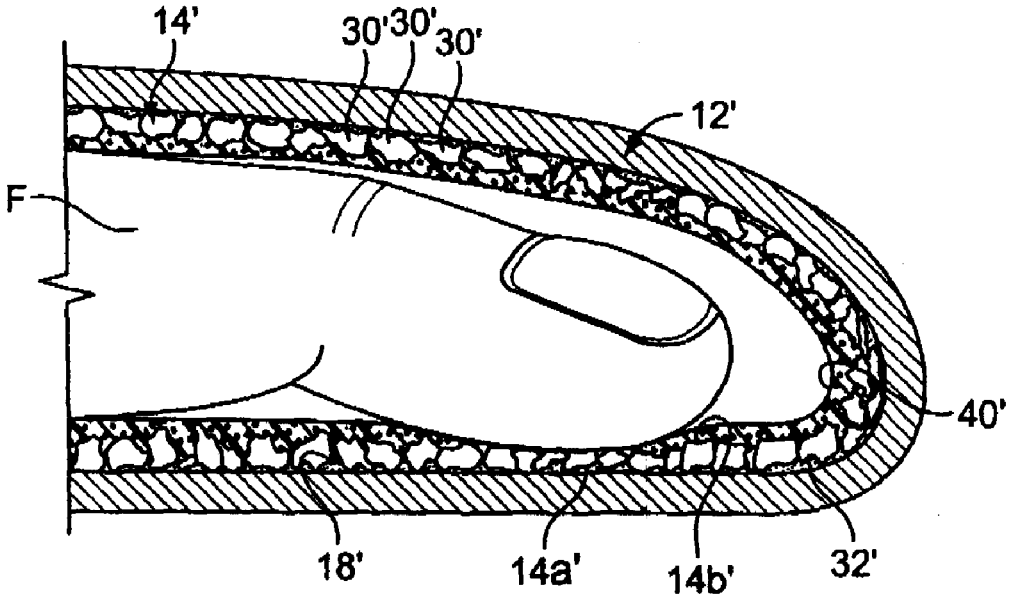
FIG. 5 is an enlarged cross-section similar to FIG. 4 but showing the compressible member in a compressed condition to reveal the cutaneous sensory elements.

FIGS. 3-5 illustrate another embodiment of a hand-wear article, also in the form of a glove, in which the glove further comprises a compressible member 40', such as a layer of foam, gel, or other suitable compressible material that "hides" the cutaneous sensory elements 14' when the compressible member is in an uncompressed condition. As such, when the glove is worn but no object is being touched or grasped, the compressible member 40' contacts the wearer's skin but the sensory elements 14' are otherwise out of contact with the wearer's skin as illustrated in FIG. 4. The compressible member 40' is suitably constructed, such as in material and/or thickness, to be compressible to a generally compressed condition in which the free ends of the sensory elements 14' extend out from the compressible member as illustrated in FIG. 5 (e.g., the skin of the wearer's finger F) upon grasping or touching an object. Thus, the height of the sensory element in this instance would be the height of the sensory element outward of the outer surface of the compressible member 40'. More suitably, the compressible member 40' is resilient such that upon termination of the compression (e.g., releasing the object being grasped) the compressible member returns substantially to its uncompressed condition so that the sensory elements 14' are once again hidden by the compressible member.

As one suitable example, the compressible member 40' may comprise a polymer foam coating applied to the inner surface of a glove as a donning layer as described in U.S. patent application Ser. No. 11/303,003 filed Dec. 15, 2005 and entitled ELASTOMERIC GLOVE CONTAINING A FOAM DONNING LAYER, which is hereby incorporated by reference. Alternatively, the compressible member 40' may comprise a fibrous non-woven or woven member overlying the skin-facing surface of the substrate 12' and in which the cutaneous sensory elements 14' are embedded otherwise hidden. In one suitable example, the compressible member 40' can be formed from the same material used to form the surge layer disclosed in U.S. Pat. No. 6,726,668 issued Apr. 27, 2004 and entitled DISPOSABLE ABSORBENT ARTICLE, which is hereby incorporated by reference. In still other embodiments, the compressible member 40' may be formed from a gel, soft compressible rubber or other suitable material. In other embodiments, it is contemplated that the substrate 12' itself may be resilient and compressible and have the cutaneous sensory elements 14' embedded or otherwise hidden therein for exposure and contact with the wearer's skin upon compression of the substrate.

Figure 6:
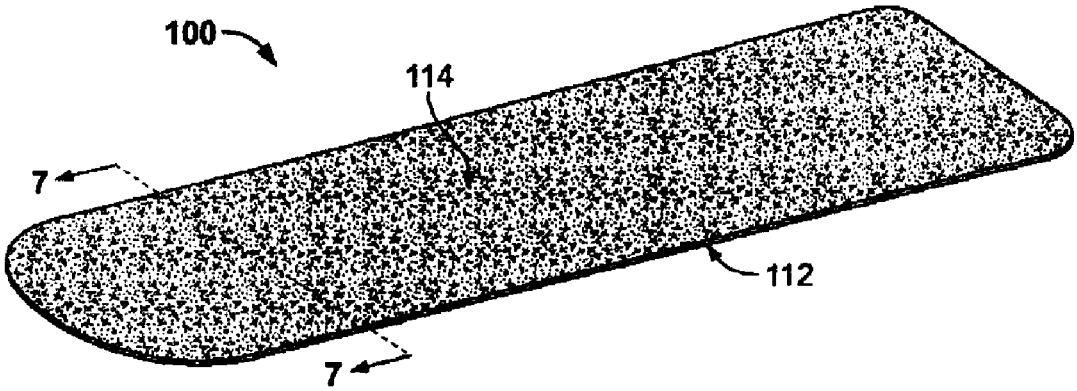
FIG. 6 is a perspective view of another embodiment of a hand-wear article in the form of an adhesive strip having cutaneous sensory elements.
Figure 7:
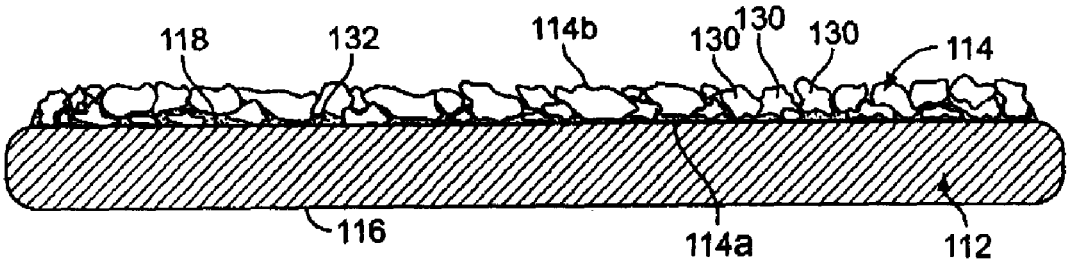
FIG. 7 is an enlarged cross-section of the strip taken along line 7-7 of FIG. 6.
Figure 8:
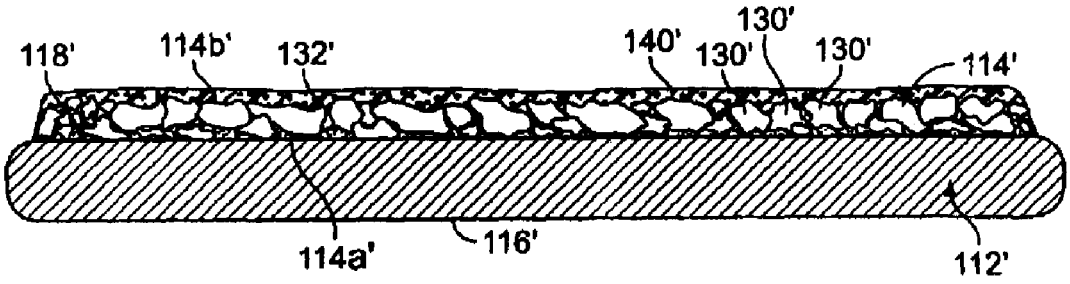
FIG. 8 is an enlarged cross-section similar to FIG. 7 but showing another configuration of the strip wherein a compressible member generally hides the cutaneous sensory elements.

FIGS. 6-8 illustrate a cutaneous sensory article comprising one or adhesive substrates 112 in the form of a strip 100 that can be adhered to selected portions of a wearer's hand, such as the palm and/or fingers. In the illustrated embodiment, the substrate 112 has a plurality of cutaneous sensory elements 114 such as any of the sensory elements described in connection with the previous embodiments, located thereon. In particular, the sensory elements 114 are located on the substrate 112 in the sharpness frequency and height ranges set forth previously to evoke a neusensory response upon grasping or touching objects adhered thereto.

An adhesive 132 is disposed on a skin-facing surface 118 of the substrate 112 to secure the strip 100 to the user or to an object. The adhesive 132 may be the same adhesive used to secure the cutaneous sensory elements 114 to the substrate or a different adhesive. The adhesive strip 100 can be applied to the user with the cutaneous sensory elements 114 in direct contact with the user or facing away from the user (as long as the substrate 112 is sufficiently compressible for the sensory elements to compress into the wearer's skin upon grasping or touching an object). That is, the cutaneous sensory elements 114 may be disposed on either the inner surface 118 (i.e., skin-facing surface) or the outer surface 116 of the substrate 112. While the adhesive strip 100 is illustrated in the form a rectangle it is understood that the strip can have other shapes (e.g., circle). A compressible member 140', such as the compressible member 40' described above with respect to FIGS. 3-5, can be applied to the strip 100 as illustrated in FIG. 8.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description shall be interpreted as illustrative and not in a limiting sense.

What is claimed is:

1. A hand-wear article for heightening the neurosensory response of the skin of the wearer, the article comprising a substrate having a skin-facing surface and a plurality of cutaneous sensory elements located on the substrate, the sensory elements being configured to define a surface roughness having a sharpness frequency in the range of about 100 Hz to about 1,000 Hz and a height in the range of about 0.1 microns to about 1000 microns, a compressible member overlying at least a portion of the skin-facing surface of the substrate and being compressible from an uncompressed condition to a compressed condition, in the uncompressed condition the compressible member generally hiding the plurality of cutaneous sensory elements to inhibit contact of the sensory elements with the skin, the sensory elements being exposed in the compressed condition of the compressible member for contact of the sensory elements with skin.

2. The article set forth in claim 1 wherein the article comprises a glove having an inner surface defining said skin-facing surface, the cutaneous sensory elements being located on at least a portion of the inner surface of the glove.

3. The article set forth in claim 1 wherein the sharpness frequency defined by the plurality of cutaneous sensory elements is in the range of about 100 Hz to about 500 Hz.

4. The article set forth in claim 3 wherein the sharpness frequency defined by the plurality of cutaneous sensory elements is in the range of about 200 Hz to about 300 Hz.

5. The article set forth in claim 4 wherein the plurality of cutaneous sensory elements is located on the inner surface of the substrate.

6. The article set forth in claim 1 wherein the plurality of cutaneous sensory elements comprises irregular shaped particles.

7. The article set forth in claim 6 wherein the plurality of irregular shaped particles comprise sand particles.

8. The article set forth in claim 1 wherein the article is a strip comprising the substrate, an adhesive on the inner surface of the substrate for securing the strip to the wearer's skin, and the cutaneous sensory elements located on the substrate.

9. The article set forth in claim 1 wherein the compressible member is resilient.

10. A hand-wear article for heightening the neurosensory response of a wearer's skin, the article having a skin-facing surface and comprising a compressible member and a plurality of cutaneous sensory elements, the compressible member being compressible from an uncompressed condition to a compressed condition thereof, said compressible member and said sensory elements being arranged relative to each other and to the skin-facing surface of the article such that in the uncompressed condition the compressible member generally hides the plurality of cutaneous sensory elements to inhibit contact of the sensory elements with the skin, the sensory elements being exposed in the compressed condition of the compressible member for contact of the sensory elements with the wearer's skin.

11. The article set forth in claim 10 wherein the compressible member is resilient.

12. The article set forth in claim 10 wherein the article comprises a substrate having a skin-facing surface, the compressible member being formed separate from and disposed on the skin-facing surface of the substrate.

13. The article set forth in claim 10 wherein the compressible member comprises a foam member.

14. The article set forth in claim 10 wherein the compressible member comprises a non-woven material.

15. The article set forth in claim 10 wherein the compressible member comprises a gel.

16. The article set forth in claim 10 wherein the plurality of cutaneous sensory elements comprises a plurality of irregular shaped particles.

17. A hand-wear article for heightening the neurosensory response of the skin of the wearer, the article comprising a substrate having a skin-facing surface and a plurality of cutaneous sensory elements located on the substrate, the sensory elements comprising irregular shaped particles having peaks, outward facing edges, and other sharp surfaces configured to define a surface roughness having a sharpness frequency in the range of about 100 Hz to about 1,000 Hz, the particles having a height in the range of about 0.1 microns to about 1000 microns.

18. The article set forth in claim 17 wherein the article comprises a glove having an inner surface defining said skin-facing surface, the cutaneous sensory elements being located on at least a portion of the inner surface of the glove.

19. The article set forth in claim 17 wherein the sharpness frequency defined by the plurality of cutaneous sensory elements is in the range of about 100 Hz to about 500 Hz.

20. The article set forth in claim 19wherein the sharpness frequency defined by the plurality of cutaneous sensory elements is in the range of about 200 Hz to about 300 Hz.

21. The article set forth in claim 20 wherein the plurality of cutaneous sensory elements is located on the inner surface of the substrate.

22. The article set forth in claim 17 wherein the plurality of irregular shaped particles comprise sand particles.

* * * * *